US007494140B2

(12) United States Patent
Schmitt

(10) Patent No.: US 7,494,140 B2
(45) Date of Patent: Feb. 24, 2009

(54) WAFFLED WOOD CORE SKATEBOARD

(76) Inventor: Paul Schmitt, 1351 Logan Ave., Costa Mesa, CA (US) 92626

( * ) Notice: Subject to any disclaimer, the term of this patent is extended or adjusted under 35 U.S.C. 154(b) by 0 days.

(21) Appl. No.: 11/029,248

(22) Filed: Dec. 31, 2004

(65) Prior Publication Data

US 2005/0115470 A1 Jun. 2, 2005

Related U.S. Application Data

(62) Division of application No. 10/431,850, filed on May 7, 2003.

(51) Int. Cl.
*B62M 1/00* (2006.01)
*A63C 17/01* (2006.01)

(52) U.S. Cl. ..... 280/87.042; 280/87.041

(58) Field of Classification Search ..... 280/87.01, 280/87.02, 87.041, 87.042, 609, 610; 144/349; 156/257

See application file for complete search history.

(56) References Cited

U.S. PATENT DOCUMENTS 2,703,443 A * 3/1955 Lee ..... 49/503
3,916,059 A * 10/1975 Molloy et al. ..... 442/385
4,084,996 A * 4/1978 Wheeler ..... 156/257
4,429,012 A * 1/1984 Danko ..... 428/12
4,816,103 A * 3/1989 Ernest ..... 156/205
5,279,436 A * 1/1994 Elliott et al. ..... 220/1.5
6,182,986 B1 * 2/2001 Smith ..... 280/87.042
6,214,142 B1 * 4/2001 Saputo ..... 156/92
6,386,561 B1 * 5/2002 Hanson ..... 280/87.042
6,648,363 B2 * 11/2003 Gordon ..... 280/610
2004/0100052 A1 * 5/2004 Chou ..... 280/87.041

* cited by examiner

*Primary Examiner*—Frank B Vanaman
(74) *Attorney, Agent, or Firm*—Charles C. H. Wu; Wu & Cheung, LLP

(57) ABSTRACT

A skateboard deck comprises a top and bottom wood portion, each wood portion having at least one layer of wood. The skateboard deck further comprises a wood core positioned in between the top and bottom wood portions. The wood core has first and second opposed surfaces, at least one of the opposed surfaces having longitudinal grooves forming hollow areas in conjunction with the top and bottom wood portions. Each of the top and bottom wood portions further comprise a crossband layer having grain perpendicular in direction to the longitudinal grooves, each crossband layer being in contact with the wood core.

8 Claims, 4 Drawing Sheets

WAFFLED WOOD CORE SKATEBOARD

The Divisional of Copending application Ser. No. 10/431,850, filed May 7, 2003.

BACKGROUND OF THE INVENTION

1. Field of the Invention

The invention relates in general to skateboard decks. More particularly, this invention relates to a skateboard deck with a waffled wood core for added mass, increased strength and lighter weight.

2. Description of the Related Art

Skateboarding has maintained its popularity as a recreational sport for numerous years. Skateboards typically consist of a deck with two surfaces. On the top surface, the skateboarder stands on and maneuvers the board. The bottom surface attaches to trucks and wheels to support the deck and allow for motion.

There is an ever-increasing demand for high-performance skateboard decks. An important consideration for high-performance is the development of decks with increased strength and reduced weight. Stronger and lighter decks allow for more aggressive maneuvers and increased responsiveness. Another consideration is manufacturing costs. It is desirable to contain the cost for manufacturing new deck designs. Thus, there is a need for skateboard decks with added mass, increased strength, increased responsiveness, decreased weight and contained manufacturing costs.

In U.S. Pat. No. 5,921,564, Olson discloses a snowboard comprising a flexible core element enveloped by a covering of resin impregnated fiberglass wherein the bottom surface of the core includes a plurality of parallel grooves running the longitudinal direction of the board such that in conjunction with resin impregnated fiberglass form a series of parallel integral hollow beam members increasing the strength of the board while simultaneously reducing the overall weight.

Instead of a core with grooves on its bottom surface only, the subject invention comprises a core with longitudinal ridges on the top, bottom or both surfaces. Forming ridges on both sides of the core substantially decreases the core weight. The longitudinal ridges also retain strength.

In addition, while Olson envelops a snowboard core with resin, the subject invention positions a skateboard core in between two wood portions. Wood is the preferred material for skateboard decks. The strength and impact resistance of wood are conducive to the aggressive and intricate maneuvers skateboarders perform.

In U.S. Pat. No. 6,460,868, Madrid discloses a corrugated skateboard deck and method of corrugating skateboard decks in the skateboard deck manufacturing process. The corrugated skateboard deck has elongated corrugations embossed into at least one of its top and bottom surfaces and generally extending between first and second ends of the skateboard deck. The elongated corrugations are made up of ridges and grooves that are pressure-formed in a method of corrugating the surfaces of skateboard decks. This method utilizes a high-density corrugated template to emboss corrugations under high pressures.

Instead of corrugating a top or bottom surface of the deck, the subject invention forms longitudinal grooves on a core positioned in between two wood portions. Positioning the core in between solid layers of wood reduces weight and increases board strength without exposing the grooves on an outside surface of the skateboard deck.

In addition, while Madrid forms the corrugations by pressure molding the skateboard deck, the subject invention forms grooves by either molding or routing the wood core. By using a router, the subject invention can mill the surface of the wood core to a desired shape and thickness.

SUMMARY OF THE INVENTION

Accordingly, one object of the present invention is to provide a skateboard deck with increased mass, increased strength, lighter weight and increased responsiveness.

A second object of the invention is to provide a skateboard deck with contained manufacturing costs.

To achieve these and other advantages and in accordance with the purpose of the invention, as embodied and broadly described herein, the invention provides a skateboard deck comprising a top and bottom wood portion, each wood portion having at least one layer of wood. The skateboard deck further comprises a wood core positioned in between the top and bottom wood portions. The wood core has first and second opposed surfaces, at least one of the opposed surfaces having longitudinal grooves forming hollow areas in conjunction with the top and bottom wood portions. Each of the top and bottom wood portions further comprise a crossband layer having grain perpendicular in direction to the longitudinal grooves, each crossband layer being in contact with the wood core.

DESCRIPTION OF THE PREFERRED EMBODIMENTS

Before proceeding with a description of the apparatus and method of the present invention, a summary of crossband layers, which may be helpful in understanding the disclosed embodiment, is provided.

A crossband layer is a layer of wood having grain perpendicular in direction compared to the length of wood. The perpendicular direction of the grain in a crossband layer, as opposed to the longitudinal layers, provides structure to the wood.

Figure 1:
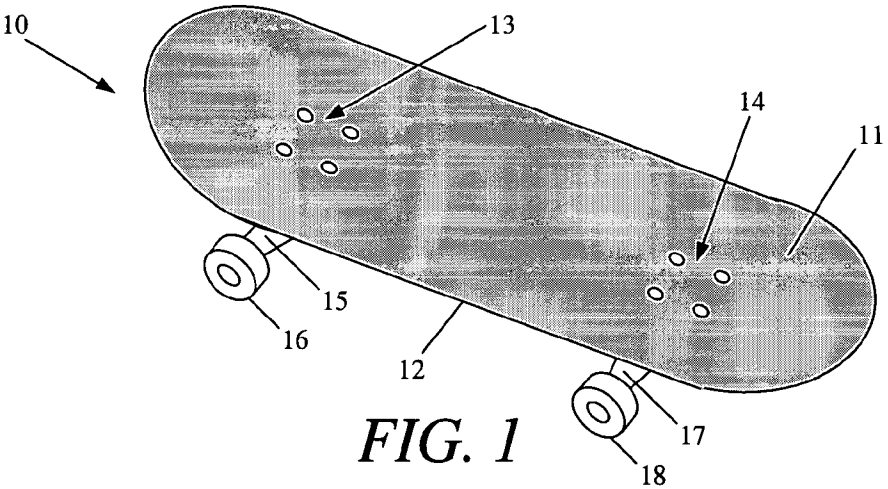
FIG. 1 is a perspective view of a typical skateboard as generally seen from the top.

Referring now to FIG. 1, a perspective view of a typical skateboard 10 as generally seen from the top is shown. The skateboard 10 includes a top surface 11 and a bottom surface 12. A pair of trucks 15, 17 mount to the bottom surface 12 at mounting holes 13, 14. Each pair of trucks 15, 17 has a pair of wheels 16, 18 attached to the end portion of trucks 15, 17.

Figure 2:
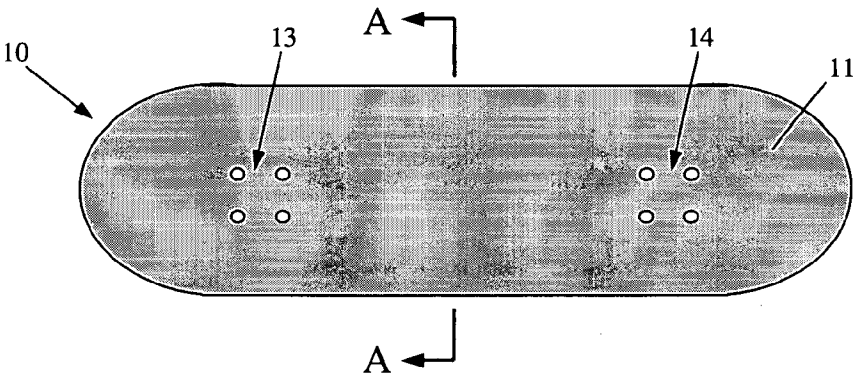
FIG. 2 is a top view of a typical skateboard deck.

As seen in FIG. 2, a top view of a typical skateboard deck 10 is shown. Mounting holes 13, 14 are visible from top surface 11.

Figure 3:
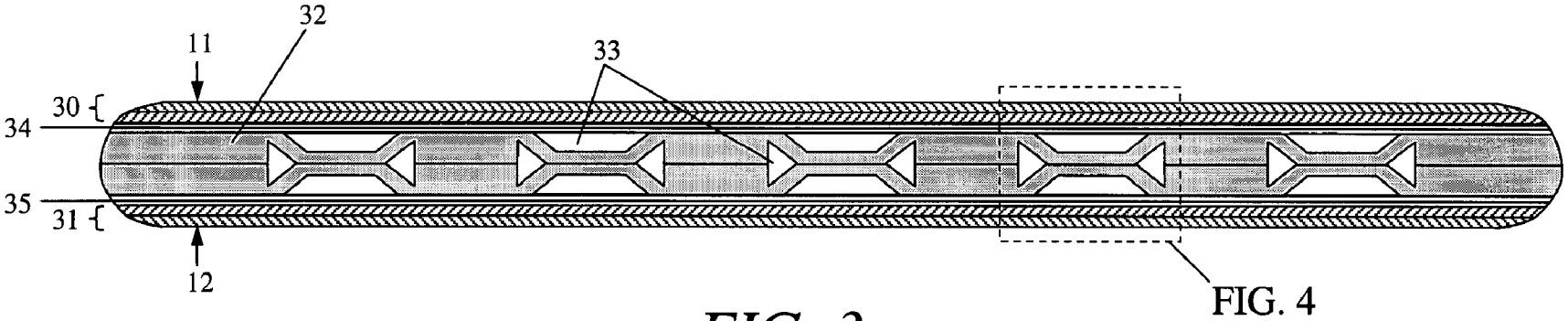
FIG. 3 is a cross-sectional view taken along the line of A-A of FIG. 2, depicting a first preferred embodiment of the invention.

With reference to FIG. 3, a cross-sectional view taken along the line of A-A of FIG. 2, depicting a first preferred embodiment of the invention is shown. Skateboard deck 10 is formed with a wood core 32 positioned in between and in direct contact with a top crossband layer 34 and a bottom crossband layer 35. The grain of crossband layers 34, 35 are perpendicular to the longitudinal direction of grooves 33 of wood core 32.

Still referring to FIG. 3, wood core 32 and crossband layers 34, 35 are further positioned in between a top wood portion 30 and bottom wood portion 31. Top wood portion 30 and bottom wood portion 31 may be formed with one or more plies of wood bonded together. In this embodiment, two plies of wood form top wood portion 30 and two plies of wood form bottom wood portion 31.

Still referring to FIG. 3, wood core 32 has parallel grooves 33 running in a longitudinal direction, forming air spaces when combined with top crossband layer 34 and bottom crossband layer 35. The grain of crossband layers 34, 35 are perpendicular in direction to parallel grooves 33, thus creating I-beams with wood core 32. This maintains the structural integrity and balance of skateboard deck 10.

Still referring to FIG. 3, grooves 33 of wood core 32 are formed using a router and glue process. Use of a router allows for continuous thickness of wood core 32. The router forms initial rectangular beams in wood core 32. After being routed, moist glue is applied to wood core 32.

The moist glue softens the initial rectangular edges of wood core 32. The wood core 32 is placed in an apparatus containing an upper and lower mold capable of operating in an opened and closed position upon the wood core 32. When said apparatus operates in a closed position, it bends and urges the initial rectangular edges of wood core 32 to a waffled shape, reshaping grooves 33. The moist glue then dries to fix theposition of wood core 32.

Figure 4:
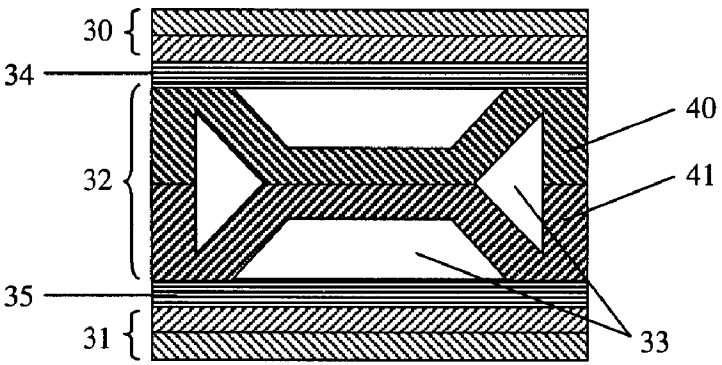
FIG. 4 is an enlarged cross-sectional view taken at (FIG. 4) in FIG. 3.

With reference to FIG. 4, an enlarged cross-sectional view taken at (FIG. 4) in FIG. 3 is shown. Two plies of wood 40, 41 are bonded to create wood core 32. Parallel grooves 33 are shaped on both the top surface and bottom surface of wood core 32. Grooves 33 are shaped in the desired manner using the routing and glue process described above. By creating grooves 33 on wood core 32, skateboard deck 10 is thicker and has more structural mass. The added structural mass increases the strength of skateboard deck 10, while the air in wood core 32 makes skateboard deck 10 lighter.

Figure 5:
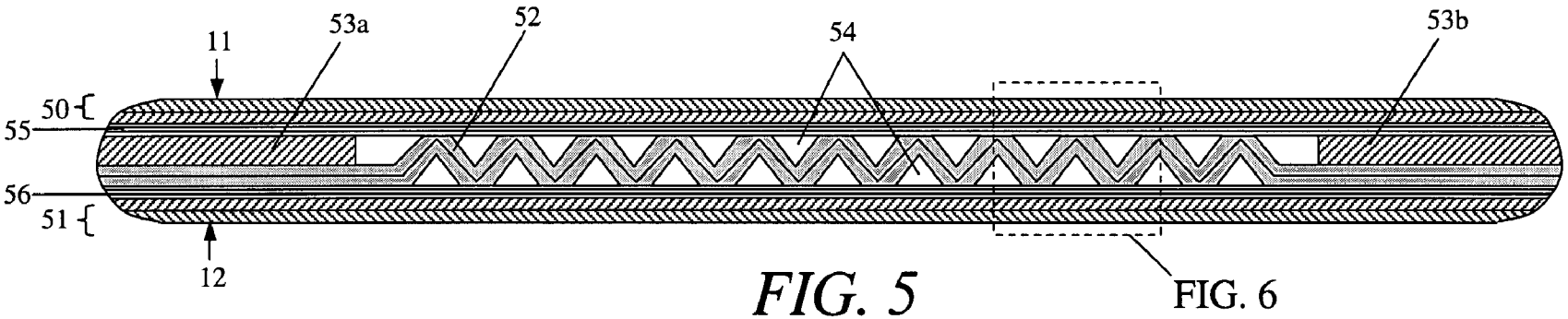
FIG. 5 is a cross-sectional view taken along the line of A-A of FIG. 2, depicting a second preferred embodiment of the invention.

With reference to FIG. 5, a cross-sectional view taken along the line of A-A of FIG. 2, depicting an alternative embodiment of the invention, is shown. Wood core 52 is positioned in between and in direct contact with top crossband layer 55 and bottom crossband layer 56. Wood pieces 53*a* and 53*b* combine to form another layer. The area in between wood pieces 53*a* and 53*b* is removed to form an internal cavity for the positioning of wood core 52. Wood core 52 and crossband layers 55, 56 are further positioned in between top wood portion 50 and bottom wood portion 51. Top wood portion 50 and bottom wood portion 51 may be formed with one or more plies of wood bonded together. In this embodiment, top wood portion 50 is formed with two plies of wood and bottom wood portion 51 is formed with two plies of wood. In addition, wood core 52 has parallel grooves 54 running in a longitudinal direction. The grain of crossband layers 55, 56 run perpendicular to parallel grooves 54.

Still referring to FIG. 5, grooves 54 of wood core 52 are formed using a molding press and template. The template is shaped to create grooves 54 and the molding press allows for a continuous thickness of wood core 52. While positioned in the molding press, moist glue is applied to wood core 52. Wood core 52 is held in the molding press until the glue cures, thus retaining the waffled shape of wood core 52. After curing, wood core 52 is positioned and glued within the internal cavity in between wood pieces 53*a* and 53*b*.

Figure 6:
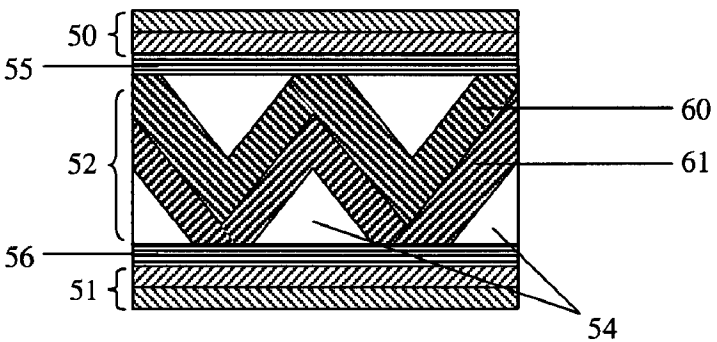
FIG. 6 is an enlarged cross-sectional view taken at (FIG. 6) in FIG. 5.

With reference to FIG. 6, an enlarged cross-sectional view taken at (FIG. 6) in FIG. 5 is shown. Two plies of wood 60, 61 are bonded to create wood core 52. Parallel grooves 54 are shaped on both the top surface and bottom surface of wood core 52. By creating grooves 54 on wood core 52, skateboard deck 10 is thicker and has more structural mass. The added structural mass increases the strength of skateboard deck 10, while the air in wood core 52 makes skateboard deck 10 lighter.

Figure 7:
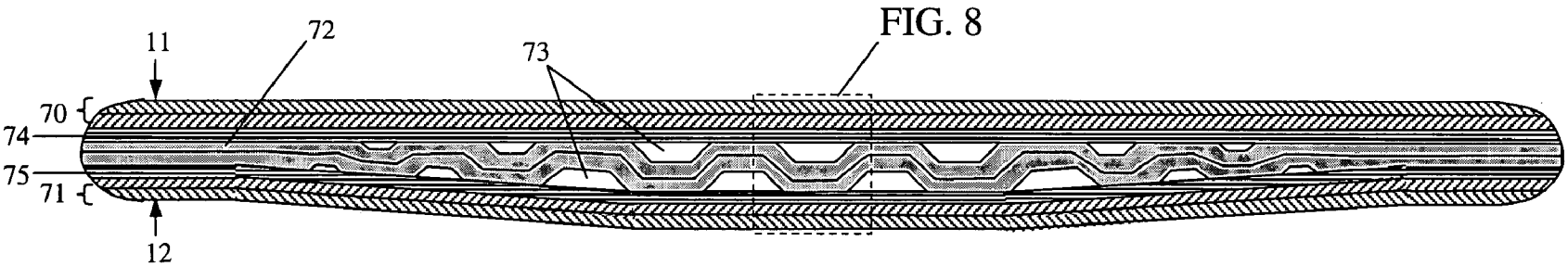
FIG. 7 is a cross-sectional view taken along the line of A-A of FIG. 2, depicting a third preferred embodiment of the invention.

With reference to FIG. 7, a cross-sectional view taken along the line of A-A of FIG. 2, depicting another alternative embodiment of the invention, is shown. Wood core 72 is positioned in between and in direct contact with top crossband layer 74 and bottom crossband layer 75. Wood core 72 and crossband layers 74, 75 are further positioned in between top wood portion 70 and bottom wood portion 71.

Top wood portion 70 and bottom wood portion 71 may be formed with one or more plies of wood bonded together. In this embodiment, top wood portion 70 is formed with two plies of wood and bottom wood portion 71 is formed with two plies of wood. In addition, wood core 72 has parallel grooves 73 running in a longitudinal direction. The grain of crossband layers 74, 75 run perpendicular to parallel grooves 73.

Still referring to FIG. 7, grooves 73 of wood core 72 are formed using a molding press and template. The template is shaped to create grooves 73 and the molding press allows for a continuous thickness of wood core 72. While positioned in the molding press, moist glue is applied to wood core 72. Wood core 72 is held in the molding press until the glue cures, thus retaining the waffled shape of wood core 72. After curing, wood core 72 is pressed a second time in a molding press having a cavity area, or spacer. During the second pressing, wood core 72 expands into the cavity area, creating the discontinuous surface of wood core 72.

Figure 8:
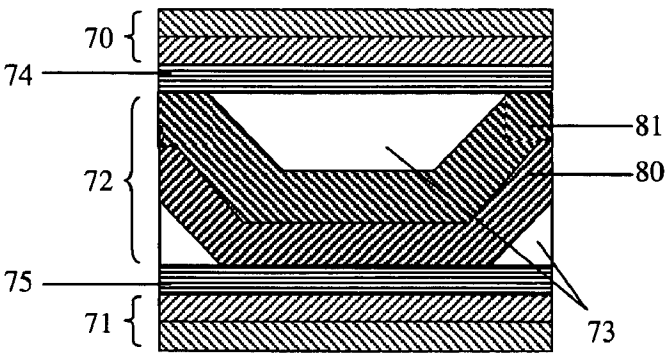
FIG. 8 is an enlarged cross-sectional view taken at (FIG. 8) in FIG. 7.

With reference to FIG. 8, an enlarged cross-sectional view taken at (FIG. 8) in FIG. 7 is shown. Two plies of wood 80, 81 are bonded to create wood core 72. Wood plies 80, 81 have dissimilar surfaces, forming a discontinuous surface thickness created by the mold and spacer process described above. The dissimilar surfaces provide added strength to the board. Parallel grooves 73 can be seen on both the top surface and bottom surface of wood core 72. By creating grooves 73 on wood core 72, skateboard deck 10 is thicker and has more structural mass. The added structural mass increases the strength of skateboard deck 10, while the air in wood core 72 makes skateboard deck 10 lighter.

Other embodiments of the invention will appear to those skilled in the art from consideration of the specification and practice of the invention disclosed herein. For example, while the subject invention has been described as applicable to a top and bottom wood layer, other raw materials such as fiberglass, plastic or resinated paper may be employed. In addition, the longitudinal grooves can run in a substantially similar direction as opposed to being parallel. It is intended that the specification and examples to be considered as exemplary only, with a true scope and spirit of the invention being indicated by the following claims.

What is claimed is:

1. A skateboard deck comprising:

a top crossband layer;

a bottom crossband layer;

an outer perimeter area; and a wood core positioned in between the top and bottom crossband layers, the wood core having first and second opposed surfaces, at least one of the opposed surfaces having longitudinal grooves forming hollow areas in conjunction with the top and bottom crossband layers;

the top and bottom crossband layers having wood grain perpendicular in direction to the longitudinal grooves;

a top wood member comprising at least one layer of wood and being positioned on top of the top crossband layer;

a bottom wood member comprising at least one layer of wood and being positioned beneath the bottom crossband layer;

wherein said outer perimeter area contains a solid unwaffled wood structure; and wherein said wood core further comprises of one or more latitudinally unitary pieces of wood across the width of said skateboard deck to create said longitudinal grooves.

2. The skateboard deck according to claim 1, wherein each of the top and bottom wood members further comprises a crossband layer having grain perpendicular in direction to the longitudinal grooves.

3. A skateboard deck comprising:

a top crossband layer;

a bottom crossband layer;

an outer perimeter area; and a wood core positioned in between the top and bottom crossband layers, the wood core having first and second opposed surfaces, at least one of the opposed surfaces having longitudinal grooves forming hollow areas in conjunction with the top and bottom crossband layers;

the top and bottom crossband layers having wood grain perpendicular in direction to the longitudinal grooves;

a top wood member comprising at least one layer of wood and being positioned on top of the top crossband layer;

a bottom wood member comprising at least one layer of wood and being positioned beneath the bottom crossband layer;

wherein said outer perimeter area contains a solid unwaffled wood structure; and wherein said wood core contains a wood having a grain structure running longitudinally and in a direction parallel to said hollow groove area.

4. A skateboard deck comprising:

a top crossband layer, a bottom crossband layer; and a wood core interposed between the top and bottom crossband layers, the wood core having first and second opposed surfaces, at least one of the opposed surfaces having longitudinal grooves forming hollow areas interposed between the top and bottom crossband layers;

the top and bottom crossband layers having wood grain perpendicular in direction to the longitudinal grooves;

a top wood member comprising at least one layer of wood and being positioned on top of the top crossband layer;

and a bottom wood member comprising at least one layer of wood and being positioned beneath the bottom crossband layer; and wherein said wood core comprises of one or more latitudinally unitary pieces of wood across the width of said skateboard deck to create said longitudinal grooves.

5. The skateboard deck according to claim 4, wherein said wood core contains wood having a grain structure running longitudinally and in a direction parallel to said hollow groove area.

6. The skateboard deck according to claim 4, wherein each of the top and bottom wood members further comprises a crossband layer having grain perpendicular in direction to the longitudinal grooves.

7. A skateboard deck comprising:

a top crossband layer, a bottom crossband layer;

a wood core interposed between the top and bottom crossband layers, the wood core having first and second opposed surfaces, at least one of the opposed surfaces having longitudinal grooves forming hollow areas interposed between the top and bottom crossband layers, the top and bottom crossband layers having wood grain perpendicular in direction to the longitudinal grooves;

a top wood member comprising at least one layer of wood and being positioned on top of the top crossband layer;

and a bottom wood member comprising at least one layer of wood and being positioned beneath the bottom crossband layer;

wherein said wood core contains a wood having a grain structure running longitudinally and in a direction parallel to said hollow groove area.

8. The skateboard deck according to claim 7, wherein each of the top and bottom wood members further comprises a crossband layer having grain perpendicular in direction to the longitudinal grooves.

* * * * *